US009754521B2

(12) United States Patent
Ryu et al.

(10) Patent No.: US 9,754,521 B2
(45) Date of Patent: Sep. 5, 2017

(54) DISPLAY DRIVE CIRCUIT AND STANDBY POWER REDUCTION METHOD THEREOF

(71) Applicant: Samsung Electronics Co., Ltd., Suwon-Si, Gyeonggi-Do (KR)

(72) Inventors: Seong-Young Ryu, Seoul (KR); Hyunsang Park, Seongnam-si (KR); Sungpil Choi, Yongin-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 583 days.

(21) Appl. No.: 14/152,144

(22) Filed: Jan. 10, 2014

(65) Prior Publication Data

US 2014/0267469 A1 Sep. 18, 2014

(30) Foreign Application Priority Data

Mar. 14, 2013 (KR) ..... 10-2013-0027384

(51) Int. Cl.
*G09G 5/10* (2006.01)
*G09G 3/20* (2006.01)

(52) U.S. Cl.
CPC ..... *G09G 3/20* (2013.01); *G09G 2310/0275* (2013.01); *G09G 2310/08* (2013.01); *G09G 2330/022* (2013.01)

(58) Field of Classification Search
CPC ..... G09G 3/2092; G09G 3/20; G09G 2310/0275; G09G 2310/08; G09G 2330/022
See application file for complete search history.

(56) References Cited

U.S. PATENT DOCUMENTS 5,751,261 A * 5/1998 Zavracky ..... A61B 3/113 257/E21.614
7,218,532 B2 5/2007 Choi et al.
7,362,167 B2 4/2008 Park et al.
7,843,265 B2 11/2010 Mavencamp
8,143,748 B2 3/2012 Ochi
(Continued)

FOREIGN PATENT DOCUMENTS

KR 2007-0121355 A 12/2007
KR 2009-0054093 A 5/2009
KR 10-1011083 B1 1/2011

*Primary Examiner* — Ilana Spar
*Assistant Examiner* — Brent D Castiaux
(74) *Attorney, Agent, or Firm* — Harness, Dickey & Pierce, P.L.C.

(57) ABSTRACT

A display driving circuit in accordance with the inventive concepts may include a source amplifier. The source amplifier may include an output transistor configured to amplify an input signal to generate an output signal, and charge a source line of a display panel using the output signal. The source amplifier may include an output transistor switch configured to control the output transistor, and a switch control block configured to receive configuration bits including on/off time information of the output transistor switch to generate a switch control signal. The on/off time information includes information for turning on the output transistor switch in synchronization with a horizontal synchronous signal associated with the display panel, and information for turning off the output transistor switch at a time when the source line of the display panel is charged to a desired charge level.

12 Claims, 9 Drawing Sheets

(56) References Cited

U.S. PATENT DOCUMENTS

| | | | | |
|---|---|---|---|---|
| 2005/0281062 | A1 | 12/2005 | Choi et al. | |
| 2006/0274595 | A1 | 12/2006 | Byeon et al. | |
| 2007/0070722 | A1 | 3/2007 | Park et al. | |
| 2007/0139984 | A1 | 6/2007 | Lo | |
| 2008/0143695 | A1* | 6/2008 | Juenemann | G09G 3/3611 345/204 |
| 2009/0295228 | A1 | 12/2009 | Ochi | |
| 2010/0134187 | A1 | 6/2010 | Mavencamp | |
| 2010/0141493 | A1* | 6/2010 | Cho | G09G 3/20 341/122 |
| 2013/0141474 | A1* | 6/2013 | Kim | H03M 1/682 345/690 |

* cited by examiner

DISPLAY DRIVE CIRCUIT AND STANDBY POWER REDUCTION METHOD THEREOF

CROSS-REFERENCE TO RELATED APPLICATIONS

This U.S. non-provisional patent application claims priority under 35 U.S.C. §119 of Korean Patent Application No. 10-2013-0027384, filed on Mar. 14, 2013, the entire contents of which are hereby incorporated by reference.

BACKGROUND

At least one inventive concept herein relates to display devices, and more particularly, to a display drive circuit and/or a standby power reduction method thereof.

A display device outputs image data as a visual image. Recently, as display devices become larger and have increased resolution, power consumption of these display devices increases. As such, the demand for extended battery life is increasing due to high quality and multifunction of a portable display device.

In a flat display, a backlight unit (BLU) consumes more than 80% of the overall power for the flat display. Thus, various methods for reducing power consumption by controlling a backlight unit (BLU) are being researched.

Drive methods of a display panel are generally classified into a dot inversion method, a column inversion method, a line inversion method and a frame inversion method. The dot inversion method has superior display ability but consumes large quantities of power. The frame inversion method consumes smaller quantities of power but has a poor display ability. As one can appreciate then, power consumption of a panel depends on a drive method. A column inversion method is being widely used now.

In the column inversion method, standby power of a source driver IC consumes a great part of the overall power. The source driver IC includes a Gamma amplifier supplying a grey voltage and a source amplifier supplying a voltage to a panel. The amount of power that the Gamma amplifier and the source amplifier consume in the source driver IC is a large part of power consumption. Thus, power consumption of a display device can be effectively reduced by reducing standby power being consumed in the Gamma amplifier and the source amplifier.

SUMMARY

According to at least one example embodiment, a display driving circuit includes a source amplifier. The source amplifier includes an output transistor configured to amplify an input signal to generate an output signal, and charge a source line of a display panel using the output signal. The source amplifier also includes an output transistor switch configured to control the output transistor. The display driving circuit also includes a switch control block configured to receive configuration bits including on/off time information of the output transistor switch to generate a switch control signal. The on/off time information includes information for turning on the output transistor switch in synchronization with a horizontal synchronous signal associated with a gate line of the display panel, and information for turning off the output transistor switch at a time when the source line of the display panel is charged to a desired charge level.

According to at least one example embodiment, the output transistor includes a pair of PMOS and NMOS transistors and drains of the PMOS and NMOS transistors are connected to each other.

According to at least one example embodiment, the output transistor switch includes first, second, third, and fourth switches. The first switch is connected to a gate of the PMOS transistor and configured to connect or cut off a control signal of the PMOS transistor according to the switch control signal. The second switch is connected to a gate of the NMOS transistor and configured to connect or cut off a control signal of the NMOS transistor according to the switch control signal. The third switch is configured to control a voltage difference between a gate of the PMOS transistor and a source of the PMOS transistor according to the switch control signal. The fourth switch is configured to control a voltage difference between a gate of the NMOS transistor and a source of the NMOS transistor according to the switch control signal.

According to at least one example embodiment, each of the third and fourth switches is a MOSFET switch.

According to at least one example embodiment, the switch control signal rises toward a high level at a time when the source line of the display panel begins to be charged, and the switch control signal falls toward a low level at a time when the source line of the display panel is charged to the desired charge level.

According to at least one example embodiment, the output transistor switch is turned on if the switch control signal rises toward a high level, and the output transistor switch is turned off if the switch control signal falls toward a low level.

According to at least one example embodiment, the display driving circuit further includes a digital to analog converter (DAC) configured to receive RGB data to generate the input signal.

According to at least one example embodiment, a standby power reduction method of a display driving circuit includes receiving configuration bits comprising on/off time information of an output transistor switch, generating a switch control signal using the configuration bits, turning on the output transistor switch according to the switch control signal, charging a source line of a panel displaying information by a source amplifier amplifying an input signal to generate an output signal while the output transistor switch maintains a turn-on state, and turning off the output transistor switch according to the switch control signal after the source line of the panel is completely charged.

According to at least one example embodiment, in the step of receiving the configuration bits, the configuration bits comprises information turning on the output transistor switch in synchronization with a horizontal synchronous signal and turning off the output transistor switch at a time when the source line of the panel is completely charged.

According to at least one example embodiment, in a step of generating the switch control signal, the switch control signal rises toward a high level at a time when the source line of the panel starts to be charged and falls toward a low level at a time when the source line of the panel is completely charged.

According to at least one example embodiment, in a step of turning on the output transistor switch, the output transistor switch is turned on when the switch control signal rises toward a high level.

According to at least one example embodiment, in a step of turning off the output transistor switch, the output transistor switch is turned off when the switch control signal falls toward a low level.

According to at least one example embodiment, a display driving circuit includes a Gamma amplifier. The Gamma amplifier includes an output transistor configured to generate a grayscale voltage, and an output transistor switch configured to control the output transistor. The driving circuit includes a Gamma amplifier switch control block configured to receive configuration bits including on/off time information of the output transistor switch to generate a switch control signal. The on/off time information includes information for turning on the output transistor switch at a time when a frame begins, and information for turning off the output transistor switch at a time when a vertical blanking interval begins.

According to at least one example embodiment, the display driving circuit is configured to scan the frame using a low frame rate method.

According to at least one example embodiment, the switch control signal rises toward a high level at a time when the frame begins, and the switch control signal falls toward a low level at a time when the vertical blanking interval begins.

According to at least one example embodiment, a display driving circuit includes a source driver integrated circuit configured to receive information data, the information data including RGB data and configuration bits. The source driver integrated circuit includes an output circuit configured to amplify the RGB data, and output, during at least a portion of a horizontal time period associated with a display panel, the amplified RGB data to at least one source line of the display panel. The source driver integrated circuit also includes an output circuit switch configured to control whether the output circuit outputs the amplified RGB data according to a switch control signal that is based on the configuration bits, the configuration bits indicating whether the at least one source line has been charged to a desired charge level.

According to at least one example embodiment, the output circuit switch is configured to control the output circuit to not output the amplified RGB data during a portion of the horizontal time period if the at least one source line is charged to the desired charge level.

According to at least one example embodiment, the at least one source line is charged to the desired charge level if a voltage at a first node of the at least one source line is equal to a voltage at a second node of the at least one source line, the first node receiving the amplified RGB data before the second node.

According to at least one example embodiment, the display driving circuit further includes a switch control block configured to generate the switch control signal based on the configuration bits.

According to at least one example embodiment, the display driving circuit further includes a timing controller configured to generate the information data based on received image data, and send the information data to the source driver integrated circuit.

BRIEF DESCRIPTION OF THE FIGURES

Example embodiments of the inventive concepts will be described below in more detail with reference to the accompanying drawings. The embodiments of the inventive concepts may, however, be embodied in different forms and should not be constructed as limited to the embodiments set forth herein. Rather, these embodiments are provided so that this disclosure will be thorough and complete, and will fully convey the scope of the inventive concept to those skilled in the art. Like numbers refer to like elements throughout.

DETAILED DESCRIPTION OF EXAMPLE EMBODIMENTS

Figure 1:
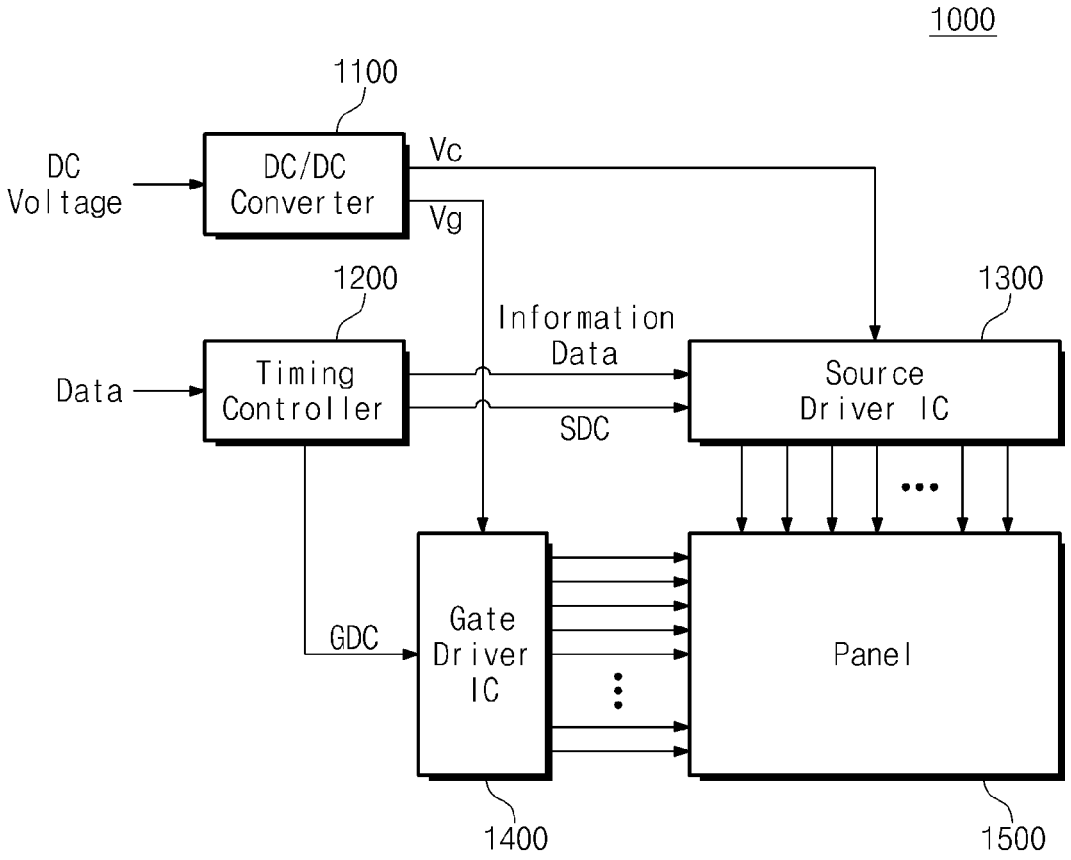
FIG. 1 is a block diagram illustrating a display device in accordance with at least one example embodiment of the inventive concepts.

Example embodiments will be understood more readily by reference to the following detailed description and the accompanying drawings. The example embodiments may, however, be embodied in many different forms and should not be construed as being limited to those set forth herein. Rather, these example embodiments are provided so that this disclosure will be thorough and complete. In at least some example embodiments, well-known device structures and well-known technologies will not be specifically described in order to avoid ambiguous interpretation.

It will be understood that when an element is referred to as being "connected to" or "coupled to" another element, it can be directly on, connected or coupled to the other element or intervening elements may be present. In contrast, when an element is referred to as being "directly connected to" or "directly coupled to" another element, there are no intervening elements present. Like numbers refer to like elements throughout. As used herein, the term "and/or" includes any and all combinations of one or more of the associated listed items.

It will be understood that, although the terms first, second, third, etc., may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of the example embodiments.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including" when used in this specification, specify the presence of stated components, steps, operations, and/or elements, but do not preclude the presence or addition of one or more other components, steps, operations, elements, and/or groups thereof.

Unless otherwise defined, all terms (including technical and scientific terms) used herein have the same meaning as commonly understood by one of ordinary skill in the art to which these example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Spatially relative terms, such as "below", "beneath", "lower", "above", "upper", and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

FIG. 1 is a block diagram illustrating a display device in accordance at least one example embodiment of the inventive concepts. A display device 1000 processes data being received from a main system (not shown) to display the data through a panel 1500.

Referring to FIG. 1, a DC/DC converter 1100 is provided with a DC voltage from the main system to provide a drive voltage Vc and Vg to a source driver IC 1300 and a gate driver IC 1400.

A timing controller 1200 receives data from a main system. The data includes information data to be displayed on a panel 1500 and configuration data for controlling the source driver IC 1300 and the gate driver IC 1400. The timing controller 1200 transmits the information data to the source driver IC 1300. The timing controller 1200 generates a source control signal SDC and a gate control signal GDC according to the configuration data.

The control signals SDC and GDC synchronize operations of the source driver IC 1300 and the gate driver IC 1400 according to the information data.

The source driver IC 1300 receives information data from the timing controller 1200. The received information data is a digital signal. The source driver IC 1300 converts the digital signal into an analog signal to display the information data on the panel 1500. The converted analog signal is transmitted to the panel 1500 according to the source control signal SDC. The source driver IC 1300 is provided with the drive voltage Vc from the DC/DC converter 1100.

The gate driver IC 1400 receives the gate control signal GDC from the timing controller 1200. The gate driver IC 1400 provides (e.g., sequentially provides) a pulse signal to a gate line according to the gate control signal GDC. The time it takes for a pulse signal to be provided to one gate line is defined to be one horizontal time period (or 1H time). If an analog signal is received from the source driver IC 1300 while a pulse signal is provided to a gate line, the information data is displayed on the panel 1500. The gate driver IC 1400 is provided with the drive voltage Vg from the DC/DC converter 1100.

The panel 1500 displays information data. One gate line is selected by the gate driver IC 1400. Information data from the source driver IC 1300 is input to the selected gate line. A pixel is formed at a point where a gate line and a source line cross each other. A group of the pixels forms a frame.

Figure 2:
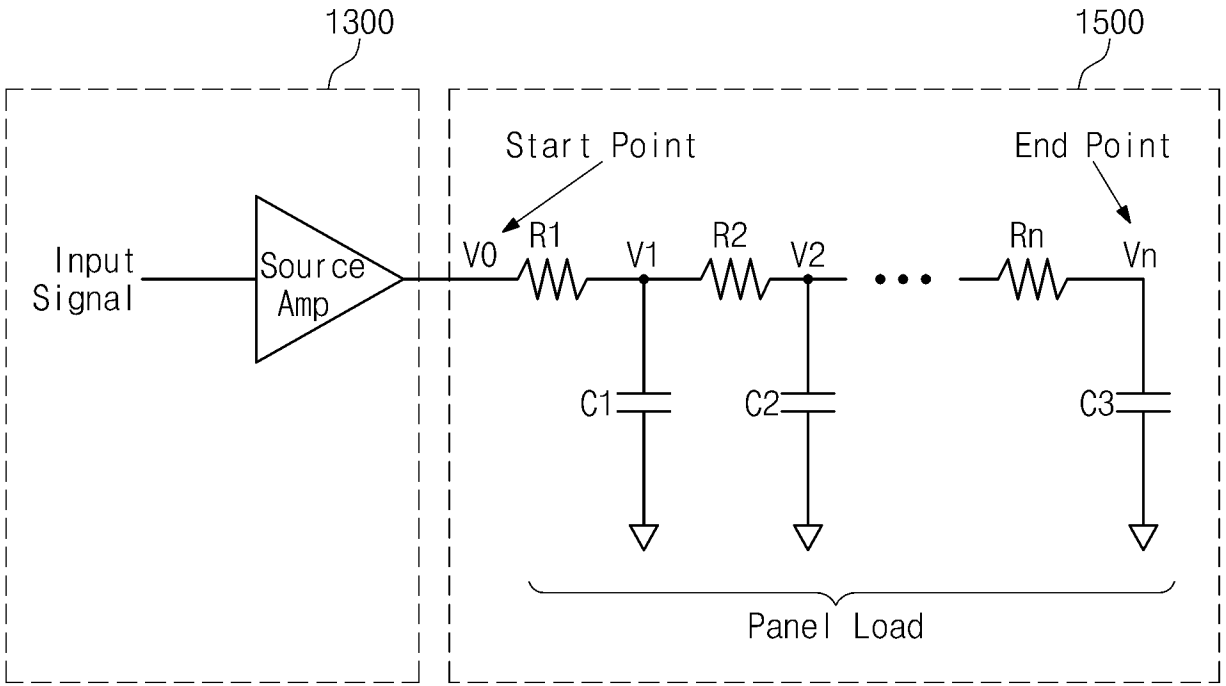
FIG. 2 is an example equivalent circuit of one source line included in a source driver IC and a panel illustrated in FIG. 1.

FIG. 2 is an equivalent circuit of one source line included in a source driver IC and a panel illustrated in FIG. 1. Referring to FIG. 2, a source amplifier at an output stage of the source driver IC 1300 receives an input signal processed by a front stage of the source driver IC 1300. The source amplifier amplifies the input signal to transmit the amplified input signal to the panel 1500. The panel 1500 includes a panel load corresponding to a source line. The panel load is charged by a signal transmitted from the source amplifier.

The panel load is charged (e.g., sequentially charged) from a capacitor C1 to a capacitor Cn. If all of the capacitors C1~Cn are charged, voltage V0 at a start point (or node), and voltages V1, V2, . . . , Vn at an end point (or node) have the same voltage level. After all of the capacitors C1~Cn are charged to a desired charge level (e.g., fully charged), the source amplifier does not have to supply power to the panel load any more. Therefore, after a capacitor Cn at an end point is charged to a desired charge level, an output transistor of the source amplifier may be turned off.

Figure 3:
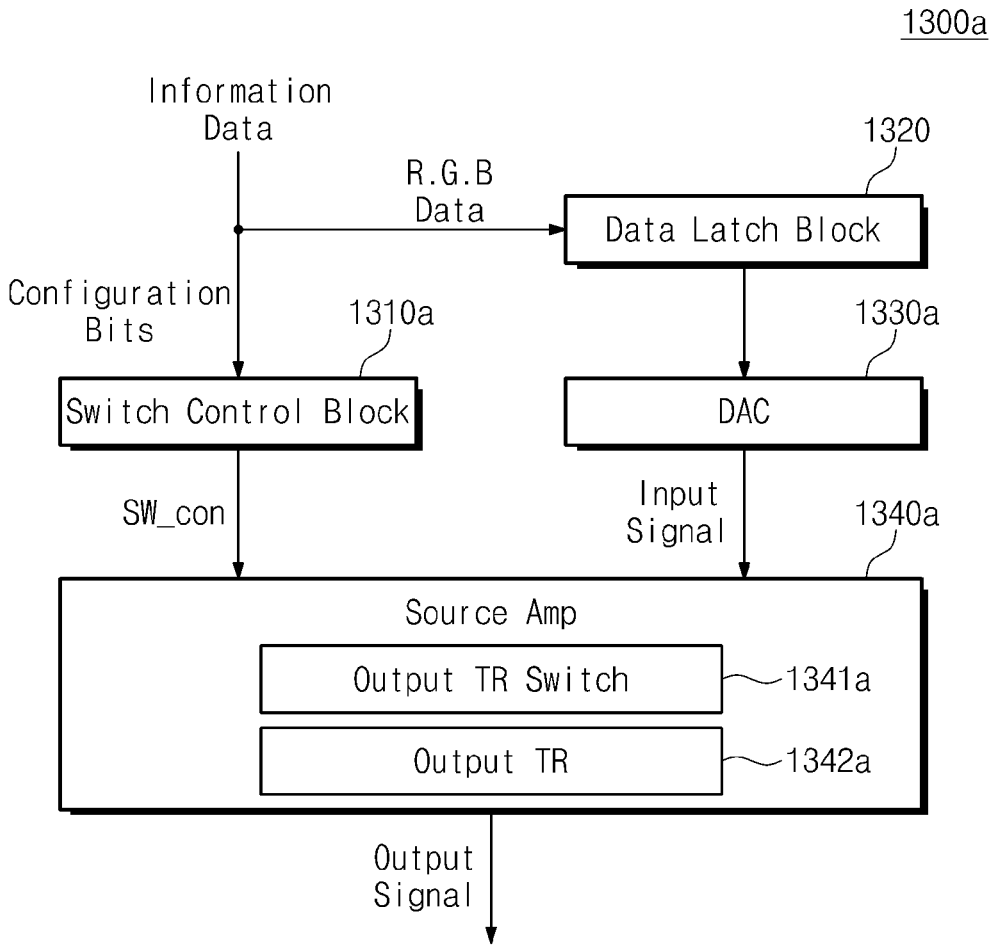
FIG. 3 is a block diagram illustrating a source driver IC illustrated in FIG. 1.

FIG. 3 is a block diagram illustrating an illustration of a source driver IC illustrated in FIG. 1. Referring to FIG. 3, a source driver IC 1300*a* receives information data from the timing controller 1200. The information data include red, blue, and green (RGB) data and configuration bits. The configuration bits include information about an operation time of an output transistor switch (or circuit) 1341*a* of a source amplifier 1340*a*. The source driver IC 1300*a* processes the received information data to transmit the information data to the panel 1500.

A switch control block 1310*a* receives information data including configuration bits. The configuration bits include information about a turn on/off time of an output transistor switch 1341*a*. The switch control block 1310*a* generates a switch control signal SW_con controlling the output transistor switch 1341*a* using the configuration bits.

The switch control signal SW_con is generated with reference to the source control signal SDC. The source control signal SDC includes a horizontal synchronous signal Hsync. The horizontal synchronous signal Hsync indicates the time that each gate line is turned on. The switch control signal SW_con rises toward a high level at the time when a gate line is turned on according to the horizontal synchronous signal Hsync.

The switch control signal SW_con falls toward a low level at the time when an end point of the panel load is sufficiently charged to a desired charge level. The time when an end point of the panel load is sufficiently charged is previously calculated by the timing controller 1200. The generated switch control signal SW_con is transmitted to the source amplifier 1340*a*.

A data latch block 1320 receives information data including RGB data. The data latch block 1320 arranges the received RGB data to suit a source line of the panel 1500. The data latch block 1320 transmits the arranged RGB data to a digital to analog (D/A) converter (DAC) 1330*a*.

The DAC 1330*a* receives the RGB data processed by the data latch block 1320. The DAC 1330*a* converts the received RGB data from a digital signal into an analog signal. The converted analog signal becomes an input signal of the source amplifier 1340*a*.

The source amplifier 1340*a* receives the input signal and the switch control signal SW_con. The source amplifier 1340*a* turns on/off the output transistor switch 1341*a* according to the switch control signal SW_con. The source amplifier 1340*a* amplifies the input signal to generate an output signal while the output transistor switch 1341*a* is turned on. The output signal is transmitted to the panel 1500.

The output transistor switch 1341*a* performs a turn on/off operation according to the switch control signal SW_con. When the switch control signal SW_con has a high level, the output transistor switch 1341*a* is turned on. When the switch control signal SW_con has a low level, the output transistor switch 1341*a* is turned off. The output transistor switch 1341*a* repeats a turn on/off operation at every 1H time. Through this process, an output transistor (or circuit) 1342*a* may be in a turn off state during a portion of 1H time after the source line of the panel is completely charged (i.e., charged to a desired charge level). Thus, standby power being consumed by the output transistor 1342*a* may be reduced.

Based on the above description, it may be said that the output transistor 1342*a* amplifies the input signal to generate an output signal. The generated output signal is transmitted to the panel 1500 and charges the source line of the panel 1500.

Figure 4:
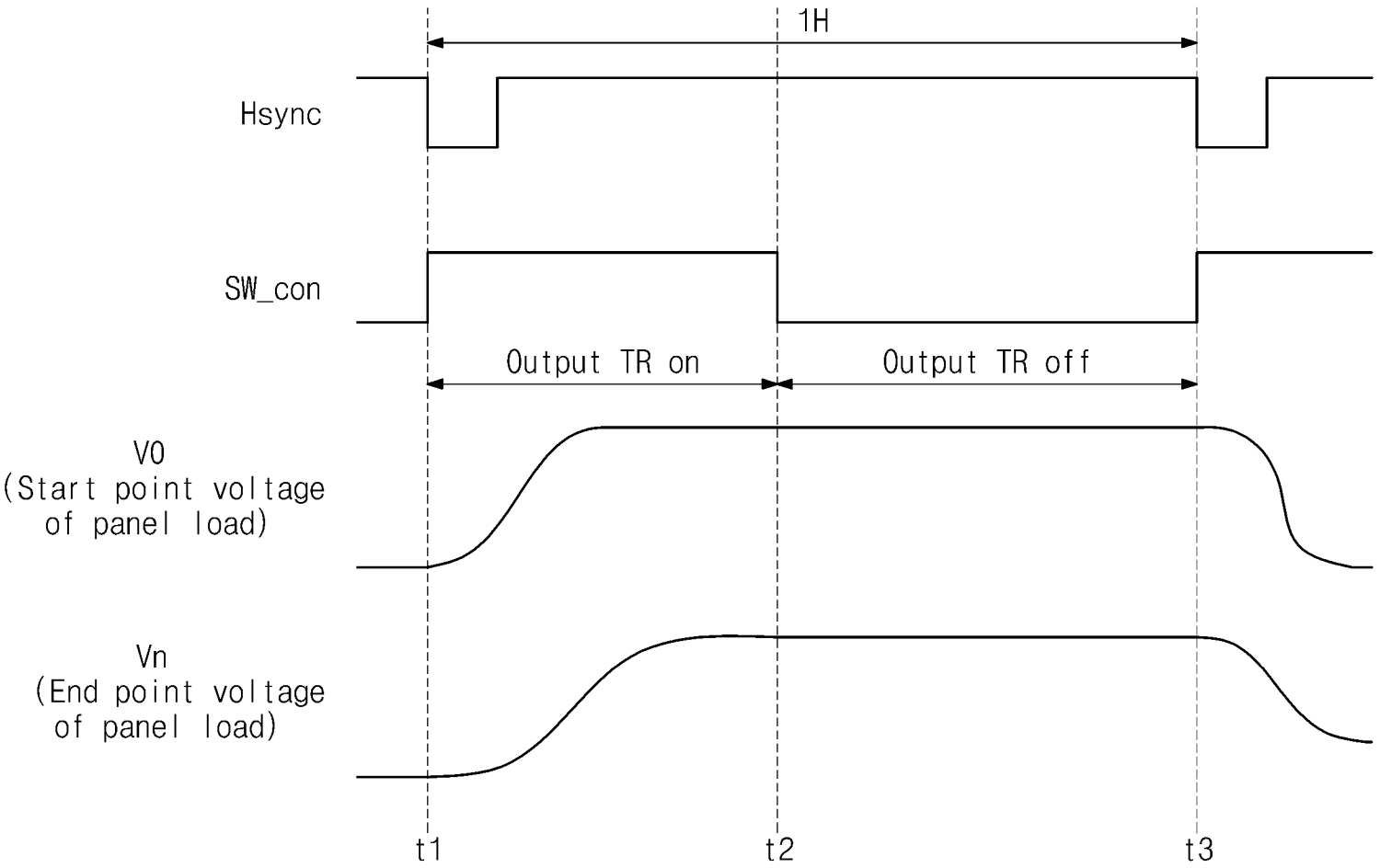
FIG. 4 is a timing diagram illustrating an example operation of the source driver IC illustrated in FIG. 3.

FIG. 4 is a timing diagram illustrating an example operation of the source driver IC illustrated in FIG. 3. Referring to FIG. 4, the horizontal synchronous signal Hsync falls toward a low level at a time t1. The horizontal synchronous signal Hsync falls again at a time t3 when 1H time elapses from the time t1. When the horizontal synchronous signal Hsync falls toward a low level (at time t1 and time t3), the switch control signal SW_con rises toward a high level. The timing controller 1200 determines (e.g., previously determines) when to send the horizontal synchronous signal Hsync to the source driver IC 1300 using the configuration bits.

The voltage V0 of a start point of the panel load gradually increases from the time t1. The voltage V0 maintains a specific value at some point between time t1 and time t2. The voltage Vn of an end point of the panel load gradually increases from the time t1. A rising rate of the voltage Vn is smaller than a rising rate of the voltage V0. From time t2, the voltage Vn maintains a level which is the same as the voltage V0. Accordingly, the capacitors of the panel load are completely charged (i.e., charged to a desired charge level) at the time t2. The switch control signal SW_con falls toward a low level at the time t2. The timing controller 1200 determines (e.g., previously determines) when the switch control signal SW_con falls toward a low level using the configuration bits.

The output transistor switch 1341*a* is turned on between the time t1 and the time t2. The output transistor switch 1341*a* is turned off between the time t2 and the time t3. Accordingly, standby power of the source amplifier 1340*a* is reduced between the time t2 and the time t3.

Figure 5:
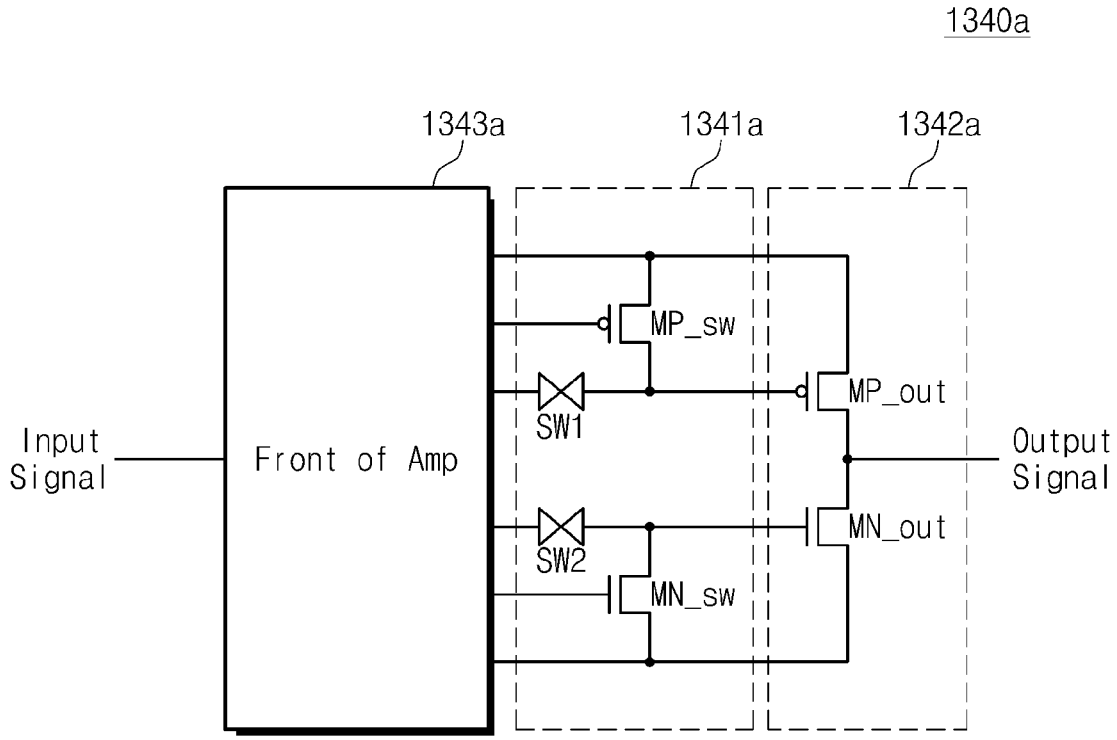
FIG. 5 is a circuit diagram illustrating a source amplifier illustrated in FIG. 3.

FIG. 5 is an example circuit diagram illustrating a source amplifier illustrated in FIG. 3. Referring to FIG. 5, the source amplifier 1340*a* includes an output transistor switch 1341*a*, an output transistor 1342*a* and a source amplifier front stage 1343*a*.

The output transistor switch 1341*a* includes first and second switches SW1 and SW2, and PMOS and NMOS switches MP_sw and MN_sw, respectively. If the output transistor switch 1341*a* is turned on, the first and second switches SW1 and SW2 are turned on and the PMOS and NMOS switches MP_sw and MN_sw are turned off. In FIG. 4, the output transistor switch 1341*a* is turned on between the time t1 and the time t2. The output transistor 1342*a* is controlled by the source amplifier front stage 1343*a* to generate an output signal.

If the output transistor switch 1341*a* is turned off, the first and second switches SW1 and SW2 are turned off and the PMOS and NMOS switches MP_sw and MN_sw are turned on. In FIG. 4, the output transistor switch 1341*a* is turned off between the time t2 and the time t3. The first switch SW1 cuts off a signal being provided from the source amplifier front stage 1343*a*. As a result, the PMOS switch MP_sw creates gate and source voltages of a gate and source of an output PMOS MP_out to be equal to each other in order to turn off the output PMOS MP_out. The second switch SW2 cuts off a signal being provided from the source amplifier front stage 1343*a*. As a result, the NMOS switch MN_sw creates gate and source voltages of a gate and source of an output NMOS MN_out to be equal to each other in order to turn off the output NMOS MN_out. Accordingly, the output transistor 1342*a* is turned off between time t2 and time t3.

Based on the above description, it may be said that the output transistor 1342*a* receives a signal from the source amplifier front stage 1343*a* to generate an output signal. Further, it may be said that the source amplifier front stage 1343*a* receives an input signal to transmit a signal operating the output transistor 1342*a*.

Figure 6:
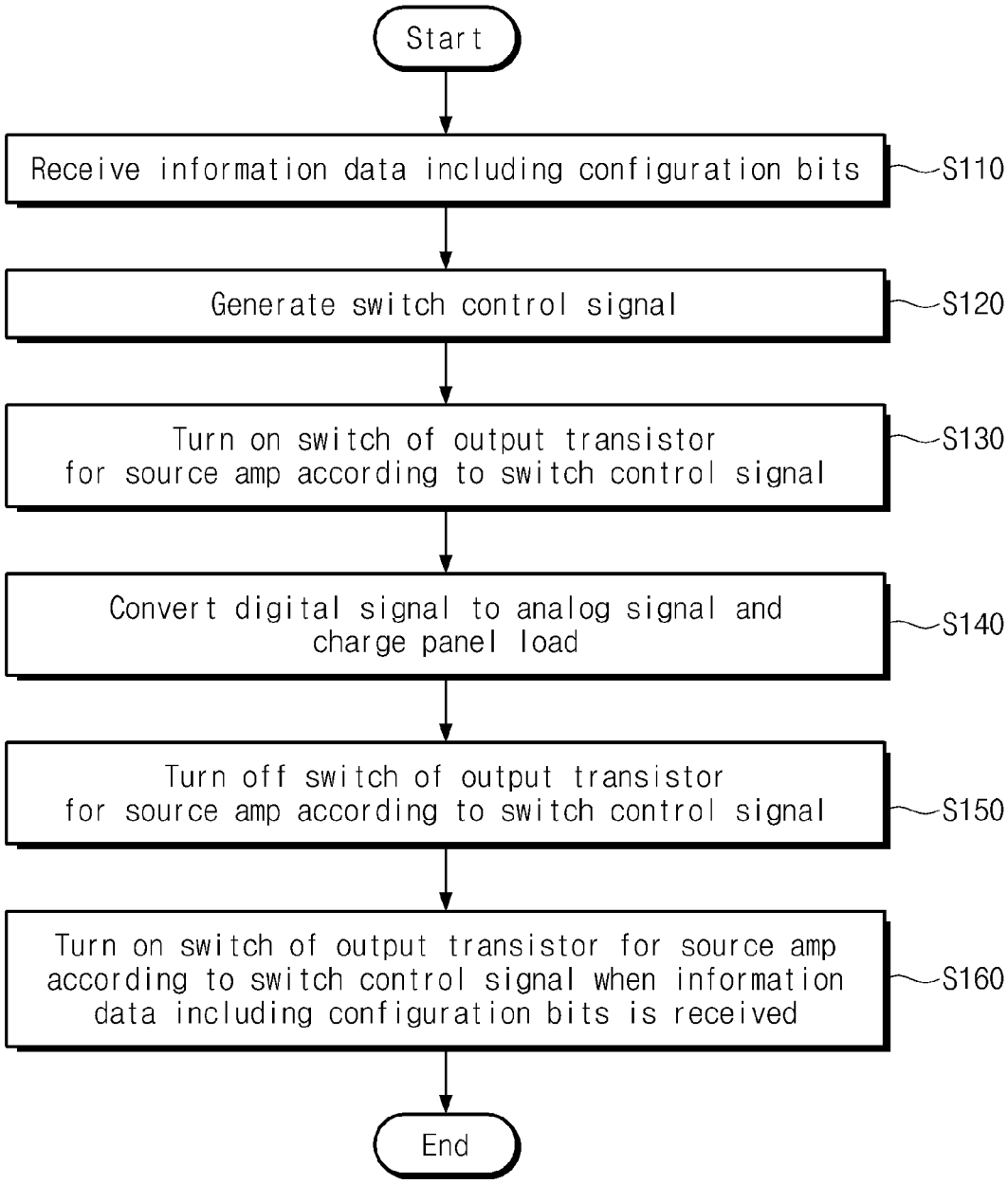
FIG. 6 is a flow chart illustrating an example standby power reduction method in accordance with the source driver IC illustrated in FIG. 3.

FIG. 6 is a flow chart illustrating a standby power reduction method in accordance with the source driver IC illustrated in FIG. 3.

In a step S110, the source driver IC 1300*a* receives information data including configuration bits. The configuration bits include information about a turn on/off operation of the output transistor switch 1341*a* of the source amplifier 1340*a*. In step S110, 1H time begins. During the 1H time, the gate driver IC 1400 selects one gate line. During the 1H time, the source driver IC 1300*a* transmits the received information data to the panel 1500.

In a step S120, the switch control block 1310*a* receives information data including configuration bits. The switch control block 1310*a* generates a switch control signal SW_con according to contents of the configuration bits. The switch control signal SW_con has a high level between the time t1 and the time t2 and has a low level between the time t2 and the time t3.

In a step S130, the output transistor switch 1341*a* of the source amplifier 1340*a* is turned on according to the switch control signal SW_con. The output transistor switch 1341*a* of the source amplifier 1340*a* is turned on at the time t1. The output transistor switch 1341*a* of the source amplifier 1340*a* maintains a turn-on state until the time t2.

In a step S140, the DAC 1330*a* converts a digital signal into an analog signal. Information data which the source driver IC 1340*a* received is a digital signal. The latch block 1320 arranges the received RGB data to suit a source line of the panel 1500. The arranged RGB data is converted from a digital signal into an analog signal by the DAC 1330*a*. The converted signal becomes an input signal of the source amplifier 1340*a*. The source amplifier 1340*a* generates an output signal according to the input signal. The output signal charges the source line of the panel 1500.

In a step S150, the output transistor switch 1341*a* of the source amplifier 1340*a* is turned off according to the switch control signal SW-con. The output transistor switch 1341*a* is turned off at the time t2. The time t2 is the time when an end point of the panel load is completely charged (i.e., charged to a desired charge level). If the panel load is completely charged, the panel 1500 does not have to be supplied with power any more. As such, the output transistor switch 1341*a* of the source amplifier 1340*a* maintains a turn-off state until the time t3. Therefore, standby power between the time t2 and the time t3 is reduced.

In a step S160, the output transistor switch 1341*a* of the source amplifier 1340*a* is turned on according to the switch control signal SW-con. The output transistor switch 1341*a* is turned on at the time t3. Accordingly, a new 1H time begins.

Through the above described process, the output transistor 1342*a* of the source amplifier 1340*a* is switched off between the time t2 and the time t3. Therefore, standby power being consumed by the output transistor 1342*a* is reduced. Power being consumed in the output transistor 1342*a* is a large part of power consumption of the source amplifier 1340*a*. Accordingly, standby power of a display device is reduced by reducing power being consumed in the output transistor 1342*a*.

Figure 7:
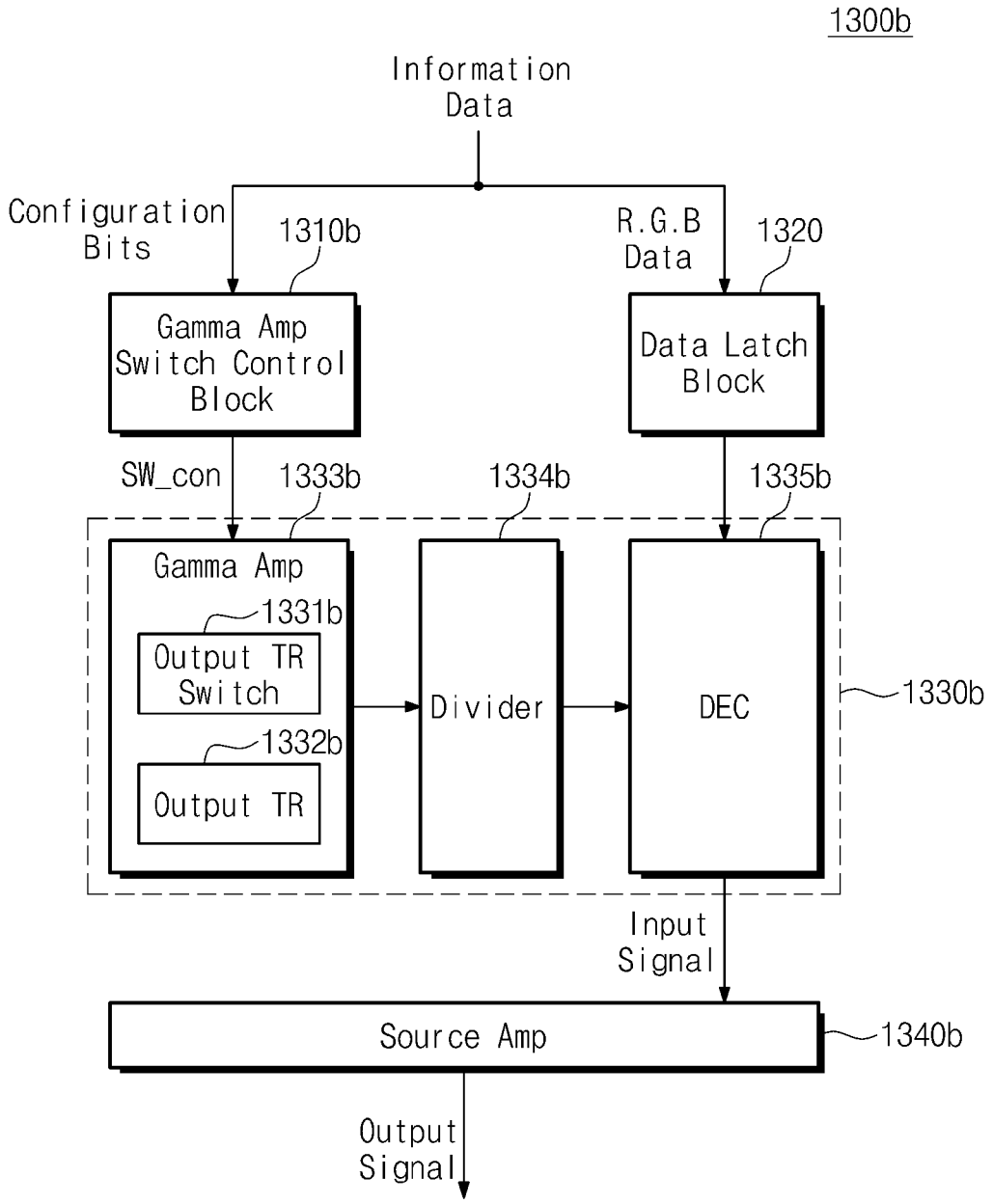
FIG. 7 is a block diagram illustrating another example of a source driver IC illustrated in FIG. 1.

FIG. 7 is a block diagram illustrating another example of a source driver IC illustrated in FIG. 1. Referring to FIG. 7, a source driver IC 1300*b* receives information data from the timing controller 1200. The information data includes RGB data and configuration bits. The configuration bits include information about an operation time of an output transistor switch 1331*b* of a Gamma amplifier 1333*b*.

A Gamma amplifier switch control block 1310*b* receives information data including configuration bits. The configuration bits include information about a turn on/off time of the output transistor switch 1331*b*. The Gamma amplifier switch control block 1310*b* generates a switch control signal SW_con for controlling the output transistor switch 1331*b* using the configuration bits.

The switch control signal SW_con is generated with reference to the source control signal SDC. The source control signal SDC includes a frame start signal. The frame start signal tells the time when one frame starts. The switch control signal SW_con rises toward a high level at a time when a frame starts according to the frame start signal. The switch control signal SW_con maintains a high level while information data is transmitted to gate lines.

The switch control signal SW_con falls toward a low level at a time when a vertical blanking interval V_blank starts. A plurality of 1H times and the vertical blanking interval V_blank are included in a scanning of one frame. After a plurality of 1H times have elapsed, a vertical blank interval V_blank starts. The vertical blanking interval V_blank is an interval in which transmission of RGB data does not exist. The switch control signal SW_con maintains a low level during the vertical blanking interval V_blank time. The generated switch control signal SW_con is transmitted to the Gamma amplifier 1333*b*.

A data latch block 1320 receives information data including RGB data. The data latch block 1320 arranges the received RGB data to suit a source line of the panel 1500. The data latch block 1320 transmits the arranged RGB data to a DAC 1330*b*.

The DAC 1330*b* receives RGB data processed by the data latch block 1320. The DAC 1330*b* converts the received RGB data from a digital signal into an analog signal. The converted analog signal becomes an input signal of a source amplifier 1340*b*. The DAC 1330*b* includes the Gamma amplifier 1333*b*, a divider 1334*b* and a decoder 1335*b*.

The Gamma amplifier 1333*b* includes the output transistor switch 1331*b* and an output transistor 1332*b*. The Gamma amplifier 1333*b* supplies a grayscale voltage to the divider 1334*b*. Thus, the Gamma amplifier 1333*b* is continuously used during 1H time in which RGB data is input. However, the output transistor 1332*b* of the Gamma amplifier 1333*b* may be turned off during the vertical blanking interval V_blank in which an input of RGB data does not exist. The Gamma amplifier 1333*b* receives the switch control signal SW_con from the Gamma amplifier switch control block 1310*b*.

The output transistor switch 1331*b* performs a turn on/off operation according to the switch control signal SW_con. When the switch control signal SW_con has a high level, the output transistor switch 1331*b* is turned on. When the switch control signal SW_con has a low level, the output transistor switch 1331*b* is turned off During the vertical blanking interval V_blank, the output transistor switch 1331*b* maintains a turn-off state. If the output transistor switch 1331*b* is turned off, standby power being consumed in the output transistor 1332*b* may be reduced.

The output transistor 1332*b* generates a grayscale voltage. The grayscale voltage is used to control brightness of RGB data. The generated grayscale voltage is transmitted to the divider 1334*b*.

The divider 1334*b* generates various voltage levels using the grayscale voltage supplied from the Gamma amplifier 1333*b*. The generated voltage levels are transmitted to the decoder 1335*b*.

The decoder 1335*b* receives RGB data arranged to suit the source line of the panel 1500 by the data latch block 1320. The decoder 1335*b* receives various voltage levels from the divider 1334*b*. The decoder 1335*b* converts the RGB data from a digital signal into an analog signal using the various voltage levels. The converted analog signal becomes an input signal of the source amplifier 1340*b*.

The source amplifier 1340*b* receives the input signal. The source amplifier 1340*b* amplifies the input signal to generate an output signal. The generated output signal is transmitted to the panel 1500.

Figure 8:
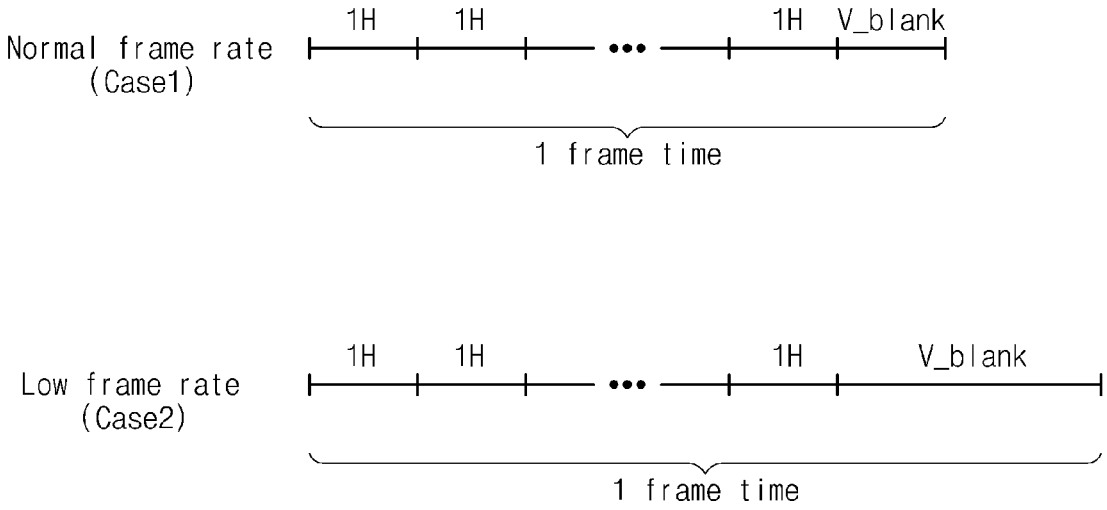
FIG. 8 is a drawing illustrating a scanning method to be used in the source driver IC illustrated in FIG. 7.

FIG. 8 is a drawing illustrating a scanning method to be used in the source driver IC illustrated in FIG. 7. Referring to FIG. 8, one frame time (i.e., the time taken to display one frame) includes a number of 1H times equal to the number of gate lines. A vertical blanking interval V_blank is included in the frame after the last 1H time. The vertical blanking interval V_blank is between individual frames, and transmission of RGB data is not performed in the vertical blanking interval V_blank. The display device 1000 transmits one frame screen to the panel 1500 during one frame time.

Examples of a frame transmission method are a normal frame rate method and a low frame rate method. The normal frame rate method transmits 60 frames during 1 second. The low frame rate method transmits 10 frames during 1 second. A moving image has a transmission frequency of 60 Hz. However, a still image may be sufficiently displayed by a transmission frequency of 10 Hz.

The low frame rate method may be used when a still image is often used. One frame time of the low frame rate method is longer than one frame time of the normal frame rate method. This is because the number of frames being transmitted during 1 second is smaller for the low frame rate method. If a 1H time of the low frame rate method is equal to 1H time of the normal frame rate method, a vertical blanking interval V_blank of the low frame rate method becomes longer than a vertical blanking interval V_blank of the normal frame rate method.

RGB data is not transmitted in the vertical blanking interval V_blank. Thus, standby power of the display device 1000 may be reduced by turning off the output transistor 1332*b* of the Gamma amplifier 1333*b* during the vertical blanking interval V_blank. When using the low frame rate method instead of the normal frame rate method, because of a longer vertical blanking interval V_blank, a standby power reduction effect is greater.

Figure 9:
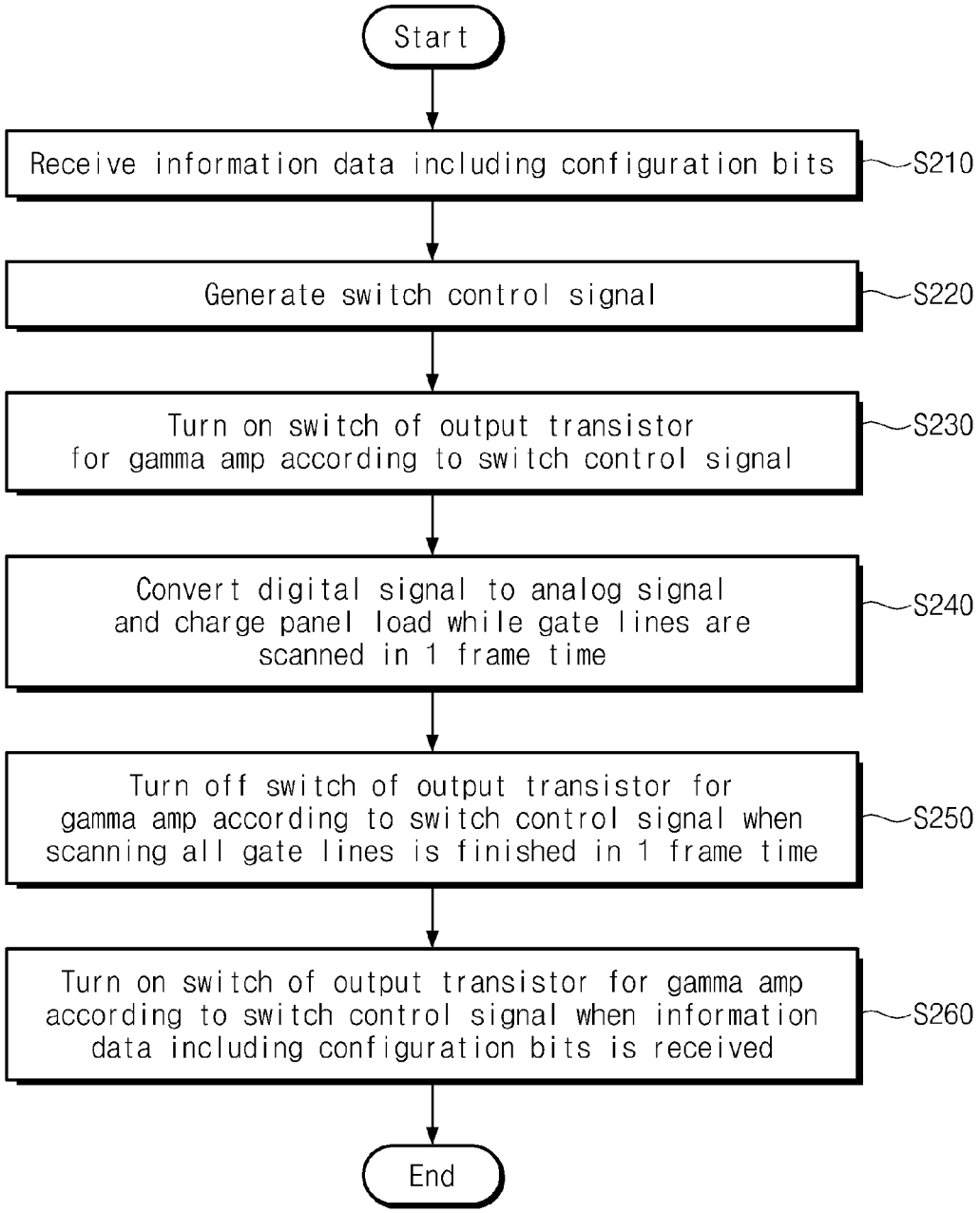
FIG. 9 is a flow chart illustrating an example standby power reduction method of the source driver IC illustrated in FIG. 7.

FIG. 9 is a flow chart illustrating an example standby power reduction method of the source driver IC illustrated in FIG. 7.

In a step S210, the source driver IC 1300*b* receives information data including configuration bits. The configuration bits include information about a turn on/off time of the output transistor switch 1331*b* of the Gamma amplifier 1333*b*. In step S210, one frame time starts. The panel displays one frame during one frame time. The source driver IC 1300*b* transmits the received information data to the panel 1500 during one frame time except the vertical blanking interval V_blank.

In a step S220, the Gamma amplifier switch control block 1310*b* receives configuration bits. The Gamma amplifier switch control block 1310*b* generates a switch control signal SW_con according to contents of the configuration bits. The switch control signal SW_con rises toward a high level at a time when one frame time starts. The switch control signal SW_con maintains a high level until a time when the vertical blanking interval V_blank starts. The switch control signal SW_con falls toward a low level at a time when the vertical blanking interval V_blank starts. The switch control signal SW_con maintains a low level during the vertical blank V_blank time.

In a step S230, the output transistor switch 1331*b* of the Gamma amplifier 1333*b* is turned on according to the switch control signal SW_con. When the switch control signal SW_con rises toward a high level, the output transistor switch 1331*b* of the Gamma amplifier 1333*b* is turned on. The output transistor switch 1331*b* of the Gamma amplifier 1333*b* maintains a turn-on state while the switch control signal SW_con maintains a high level.

In a step S240, the DAC 1330*b* converts a digital signal into an analog signal. Information data which the source driver IC 1300*b* received is a digital signal. The information data includes RGB data. The data latch block 1320 arranges the received RGB data to suit a source line of the panel 1500. The arranged RGB data is converted from a digital signal into an analog signal by the DAC 1330*b*. The converted signal becomes an input signal of the source amplifier 1340*b*. The source amplifier 1340*b* charges a source line of the panel 1500 according to the input signal. The output transistor switch 1331*b* of the Gamma amplifier 1333*b* maintains a turn-on state until the information data is input to desired gate lines.

In a step S250, the output transistor switch 1331*b* of the Gamma amplifier 1333*b* is turned off according to the switch control signal SW_con. When the switch control signal SW_con falls toward a low level, the output transistor switch 1331*b* of the Gamma amplifier 1333*b* is turned off. The switch control signal SW_con falls toward a low level at a time when information is input to the desired gate lines in one frame time. The output transistor switch 1331*b* of the Gamma amplifier 1333*b* maintains a turn-off state while the switch control signal SW_con maintains a low level. Since information data being transmitted to the panel 1500 does not exist during the vertical blanking interval V_blank, the output transistor switch 1331*b* of the Gamma amplifier 1333*b* may be turned off. Therefore, standby power of the display device 1000 is reduced during the vertical blanking interval V_blank.

In a step S260, the output transistor switch 1331*b* of the Gamma amplifier 1333*b* is turned on according to the switch control signal SW_con. In step S260, a new one frame time starts. If the new one frame time starts, the switch control signal SW_con rises toward a high level. If the switch control signal SW_con rises toward a high level, the output transistor switch 1331*b* of the Gamma amplifier 1333*b* is turned on.

Through those processes, the output transistor switch 1331*b* of the Gamma amplifier 1333*b* is cut off. Therefore, power being consumed by the output transistor 1332*b* may be reduced. Power being consumed by the output transistor 1332*b* is a large part of power consumption of the Gamma amplifier 1333*b*. Standby power of the display device is reduced by cutting off power consumption of the output transistor 1332*b*.

The above-disclosed subject matter is to be considered illustrative, and not restrictive, and the appended claims are intended to cover all such modifications, enhancements, and other embodiments, which fall within the true spirit and scope of the inventive concepts. Thus, the scope of the inventive concepts is to be determined by the following claims and their equivalents, and shall not be restricted or limited by the foregoing detailed description.

What is claimed is:

1. A display driving circuit, comprising:

a source amplifier including, an output transistor configured to, amplify an input signal to generate an output signal, and charge a source line of a display panel using the output signal, and an output transistor switch configured to control the output transistor; and a switch control block configured to receive configuration bits including on/off time information of the output transistor switch to generate a switch control signal, the on/off time information including, information for turning on the output transistor switch in synchronization with a horizontal synchronous signal associated with the display panel, and information for turning off the output transistor switch at a time when the source line of the display panel is substantially fully charged.

2. The display driving circuit of claim 1, wherein the output transistor includes a pair of transistors, the pair of transistors including a PMOS transistor and an NMOS transistor, and drains of the PMOS transistor and the NMOS transistor are connected to each other.

3. The display driving circuit of claim 2, wherein the output transistor switch comprises:

a first switch connected to a gate of the PMOS transistor and configured to connect or cut off a control signal of the PMOS transistor according to the switch control signal;

a second switch connected to a gate of the NMOS and configured to connect or cut off a control signal of the NMOS transistor according to the switch control signal;

a third switch configured to control a voltage difference between a gate of the PMOS transistor and a source of the PMOS transistor according to the switch control signal; and a fourth switch configured to control a voltage difference between a gate of the NMOS transistor and a source of the NMOS transistor according to the switch control signal.

4. The display driving circuit of claim 3, wherein each of the third switch and the fourth switch is a MOSFET switch.

5. The display driving circuit of claim 1, wherein the switch control signal rises toward a high level at a time when the source line of the display panel begins to be charged, and the switch control signal falls toward a low level at a time when the source line of the display panel is substantially fully charged.

6. The display driving circuit of claim 5, wherein the output transistor switch is turned on if the switch control signal rises toward a high level, and the output transistor switch is turned off if the switch control signal falls toward a low level.

7. The display driving circuit of claim 1, further comprising:

a digital to analog converter (DAC) configured to receive RGB data to generate the input signal.

8. A display driving circuit, comprising:

a source driver integrated circuit configured to receive information data, the information data including RGB data and configuration bits, the source driver integrated circuit including, an output circuit configured to, amplify the RGB data, and output, during at least a portion of a horizontal time period associated with a display panel, the amplified RGB data to at least one source line of the display panel, and an output circuit switch configured to control whether the output circuit outputs the amplified RGB data according to a switch control signal that is based on the configuration bits, the configuration bits indicating whether the at least one source line has been substantially fully charged.

9. The display driving circuit of claim 8, wherein the output circuit switch is configured to control the output circuit to not output the amplified RGB data during a portion of the horizontal time period if the at least one source line is substantially fully charged.

10. The display driving circuit of claim 9, wherein the at least one source line is substantially fully charged if a voltage at a first node of the at least one source line is equal to a voltage at a second node of the at least one source line, the first node receiving the amplified RGB data before the second node.

11. The display driving circuit of claim 8, further comprising:

a switch control block configured to generate the switch control signal based on the configuration bits.

12. The display driving circuit of claim 8, further comprising:

a timing controller configured to, generate the information data based on received image data, and send the information data to the source driver integrated circuit.

* * * * *